US010129659B2

(12) United States Patent
Biswas

(10) Patent No.: US 10,129,659 B2
(45) Date of Patent: Nov. 13, 2018

(54) DIALOG ENHANCEMENT COMPLEMENTED WITH FREQUENCY TRANSPOSITION

(71) Applicant: Dolby International AB, Amsterdam, Zuidoost (NL)

(72) Inventor: Arijit Biswas, Schwaig bei Nuernberg (DE)

(73) Assignee: Doly International AB, Amsterdam, Zuidoost (NL)

( * ) Notice: Subject to any disclaimer, the term of this patent is extended or adjusted under 35 U.S.C. 154(b) by 0 days.

(21) Appl. No.: 15/567,270

(22) PCT Filed: May 4, 2016

(86) PCT No.: PCT/EP2016/060004
§ 371 (c)(1),
(2) Date: Oct. 17, 2017

(87) PCT Pub. No.: WO2016/180704
PCT Pub. Date: Nov. 17, 2016

(65) Prior Publication Data

US 2018/0160236 A1 Jun. 7, 2018

Related U.S. Application Data

(60) Provisional application No. 62/161,442, filed on May 14, 2015.

(30) Foreign Application Priority Data

May 8, 2015 (EP) ..... 15167000

(51) Int. Cl.
*H04R 25/00* (2006.01)

(52) U.S. Cl.
CPC ..... *H04R 25/353* (2013.01); *H04R 25/505* (2013.01); *H04R 2225/43* (2013.01)

(58) Field of Classification Search
CPC H04R 25/353; H04R 25/505; H04R 2225/43; G06K 9/627; G06N 7/005; G10K 11/175
(Continued)

(56) References Cited

U.S. PATENT DOCUMENTS 7,248,711 B2 7/2007 Allegro
7,328,162 B2 2/2008 Liljeryd
(Continued)

FOREIGN PATENT DOCUMENTS

EP 1441562 3/2010
WO 2014/206491 12/2014

OTHER PUBLICATIONS

Simpson, Andrea "Frequency-Lowering Devices for Managing High-Frequency Hearing Loss: A Review" Trends in Amplication, Trends in Amplification, vol. 13, No. 2, 2009.
(Continued)

*Primary Examiner* — Tuan D Nguyen

(57) ABSTRACT

A method, a system and a computer program product are disclosed for enhancing an audio signal in relation to a hearing impairment. An input signal is obtained comprising input sub-band signals in a frequency range comprising a source range and a target range. The input sub-band signals in the source range are selectively transposed into transposed sub-band signals in the target range according to a predefined transposing rule. A masking threshold is determined based on a predefined perceptual model and perceptually relevant sub-band signals of the transposed sub-band signals in the target range exceeding the masking threshold are detected. Input sub-band signals in the target range are selectively replaced with corresponding detected perceptu-
(Continued)

ally relevant sub-band signals of the transposed sub-band signals in the target range.

15 Claims, 6 Drawing Sheets

(58) Field of Classification Search
USPC ..... 381/312–320, 73.1, 94.1–94.3, 98
See application file for complete search history.

(56) References Cited

U.S. PATENT DOCUMENTS

| | | | | |
|---|---|---|---|---|
| 7,742,927 | B2 | 6/2010 | Gournay | |
| 8,031,892 | B2 | 10/2011 | Andersen | |
| 8,761,422 | B2 | 6/2014 | Fitz | |
| 8,818,541 | B2 | 8/2014 | Villemoes | |
| 8,949,113 | B2 * | 2/2015 | Holmberg | H04R 25/353 704/200.1 |
| 2003/0026436 | A1 * | 2/2003 | Raptopoulos | G10K 11/175 381/71.4 |
| 2010/0135511 | A1 * | 6/2010 | Pontoppidan | H04R 25/505 381/313 |
| 2011/0004479 | A1 | 1/2011 | Ekstrand | |
| 2011/0249843 | A1 * | 10/2011 | Holmberg | H04R 25/353 381/316 |
| 2012/0065983 | A1 | 3/2012 | Ekstrand | |
| 2012/0278088 | A1 | 11/2012 | Villemoes | |
| 2012/0308060 | A1 * | 12/2012 | Pontoppidan | H04R 25/505 381/317 |
| 2013/0041673 | A1 | 2/2013 | Nagel | |
| 2013/0051566 | A1 | 2/2013 | Pontoppidan | |
| 2013/0051571 | A1 | 2/2013 | Nagel | |
| 2013/0136282 | A1 * | 5/2013 | McClain | H03G 3/32 381/316 |
| 2013/0259254 | A1 * | 10/2013 | Xiang | G10K 11/175 381/73.1 |
| 2014/0105435 | A1 | 4/2014 | Allegro-Baumann | |
| 2014/0201126 | A1 * | 7/2014 | Zadeh | G06K 9/627 706/52 |
| 2015/0249892 | A1 * | 9/2015 | Kuhnel | H04R 25/552 381/315 |
| 2015/0256948 | A1 * | 9/2015 | Nielsen | H04R 25/75 381/320 |

OTHER PUBLICATIONS

Xiao, X. et al "Evaluation of Frequency-Lowering Algorithms for Intelligibility of Chinese Speech in Hearing-Aid Users" National Natural Science Foundation of China and Chinese Academy of Sciences. Published by Elsevier Limited and Science in China Press, vol. 19, Issue 6, Jun. 10, 2009, pp. 741-749.

Perreau, Ann Elizabeth "The Contribution of a Frequency-Compression Hearing Aid to Contralateral Cochlear Implant Performance" Thesis, The University of Iowa, 2011.

ETSI, Digital Audio Compression (AC-4)Standard, Apr. 2014.

Haastrup, Astrid "Improving High Frequency Audibility with Sound Shaper" pp. 1-8 Resound, http://www.gnhearing.se/~/media/DownloadLibrary/ReSound/Products/LiNX/White,-sp-,paper,-sp-,sound,-sp-,shaper.ashx.

Phonak's "SoundRecover—A Breakthrough in Enhancing Intelligibility" https://www.audiologyonline.com/releases/soundrecover-breakthrough-in-enhancing-intelligibility-3719.

Galster, J.A. et al "Spectral IQ: Audibly Improving Access to High-Frequency Sounds" Starkey, pp. 1-8 https://starkeypro.com/pdfs/technical-papers/Spectral_iQ_Technical_Paper.pdf.

Serman, M. et al "Frequency Compression" Siemens, updated Oct. 2013, pp. 1-12. https://www.bestsound-technology.co.uk/nhs/media/2014/07/Octiv_WhiteP-FreqComp.pdf.

* cited by examiner

DIALOG ENHANCEMENT COMPLEMENTED WITH FREQUENCY TRANSPOSITION

TECHNICAL FIELD

The invention disclosed herein generally relates to decoding of audio signals, and in particular to a method and system for enhancing an audio signal in relation to a hearing impairment.

BACKGROUND ART

Different approaches for enhancing audio signals in relation to hearing impairments have been suggested. For example, isolation and amplification of speech in an audio signal and/or suppressing of sound that interfere with speech in an audio signal have been suggested. However, such amplification does not specifically take into account hearing impairment in specific frequency ranges. For example, one type of hearing impairment involves high frequency hearing loss such that the audibility of a person drops beyond a crossover frequency. For such hearing impairments, amplification is not sufficient to increase the audibility in the higher frequencies.

Methods have also been suggested for frequency lowering, for example by frequency compression where input frequencies in a frequency interval from a lower frequency limit below a crossover frequency to a upper frequency limit above the crossover frequency are compressed to output frequencies in a frequency interval from the lower frequency limit to the crossover frequency. Furthermore, frequency transposing has also been suggested where frequency components of a target range below a crossover frequency are replaced by corresponding frequency components of a source range above the crossover frequency and where frequency components of the target range are combined with corresponding frequency components of the target range.

Frequency transposing methods include methods such as disclosed in U.S. Patent Application with Pub. No. US 2014/0105435.

All techniques for frequency transposing suffer from issues relating to loss of relevant frequency components in the source range and/or in the target range. Hence, there is a need for further methods for enhancing an audio signal in relation to a hearing impairment in certain frequency bands.

BRIEF DESCRIPTION OF THE DRAWINGS

Example embodiments will now be described with reference to the accompanying drawings, on which.

All figures are schematic and generally only depict parts which are necessary in order to elucidate the disclosure, whereas other parts may be omitted or merely suggested. Unless otherwise indicated, like reference numerals refer to like parts in different figures.

DETAILED DESCRIPTION

Figure 1:
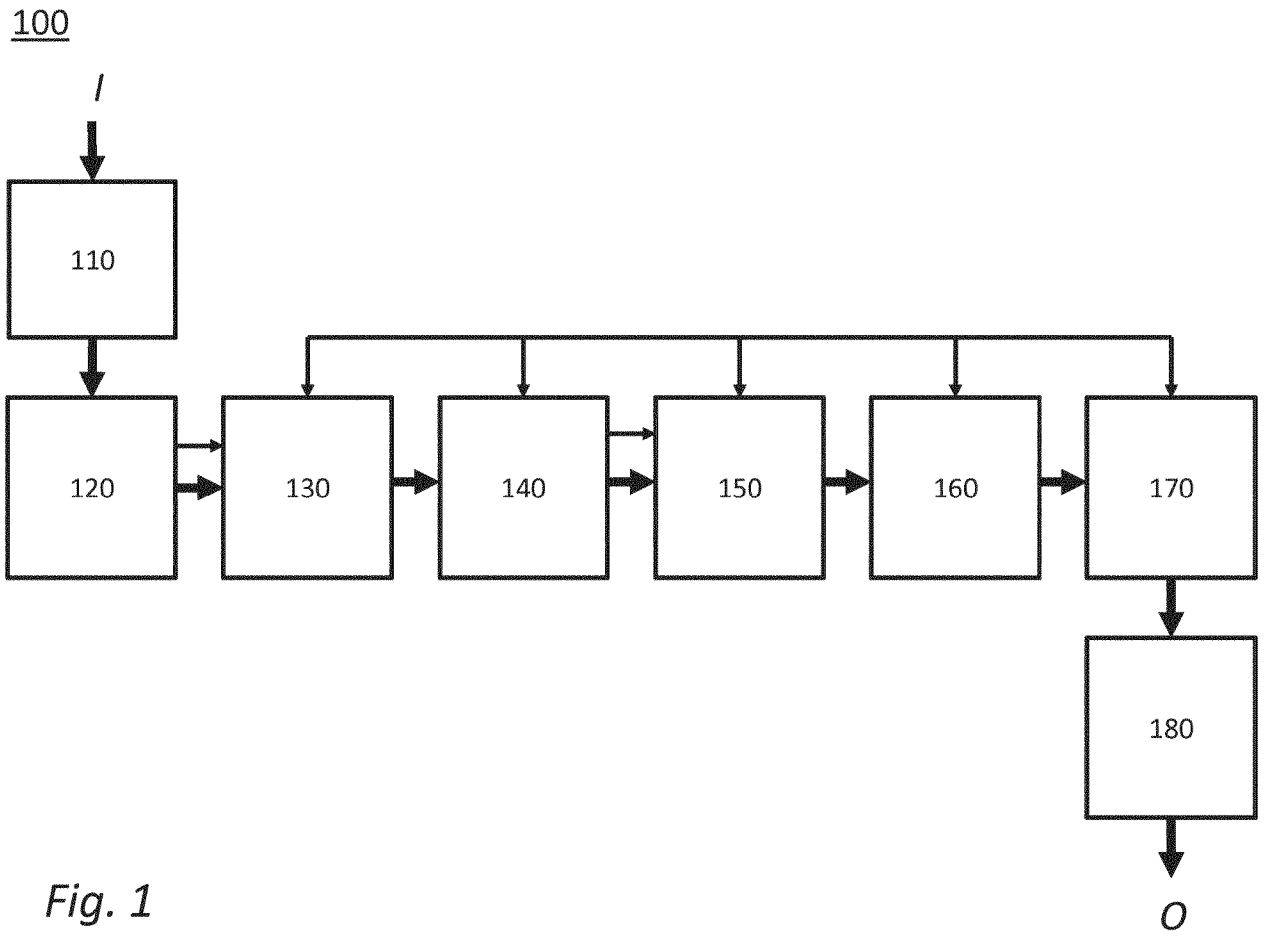
FIG. 1 is a generalized block diagram of a decoding system.

In view of the above, an objective is to provide decoder systems, associated methods and computer program products aiming at providing enhancement of an audio signal in relation to a hearing impairment.

I. Overview

According to one aspect, example embodiments propose methods, decoding systems, and computer program products for enhancing an audio signal in relation to a hearing impairment. The proposed methods, decoding systems and computer program products may generally have the same features and advantages.

According to example embodiments, there is provided a method for enhancing an audio signal in relation to a hearing impairment. The method includes obtaining an input signal comprising input sub-band signals in a frequency range comprising a source range and a target range, and selectively transposing the input sub-band signals in the source range into transposed sub-band signals in the target range according to a predefined transposing rule. The method further includes determining a masking threshold based on a predefined perceptual model, and detecting perceptually relevant sub-band signals of the transposed sub-band signals in the target range, the perceptually relevant sub-band signals of the transposed sub-band signals in the target range exceeding the masking threshold. The method further includes selectively replacing input sub-band signals in the target range with corresponding detected perceptually relevant sub-band signals of the transposed sub-band signals in the target range.

As used herein, sub-band signals are representations of an audio signal within sub-bands of frequencies for one or more time intervals. The size of the sub-bands (frequency resolution) depends on the type of representation, sampling rate etc.

The input sub-band signals in the source range are selectively transposed into transposed sub-band signals in the target range according to a predefined transposing rule. The predefined transposing rule determines which of the input sub-band signals should be transposed from the source range to the target range.

As used herein, the masking threshold varies with frequency, i.e. the masking threshold would typically be different for different sub-bands. Perceptually relevant sub-band signals of the transposed sub-band signals in the target range are detected as the sub-band signals of the transposed sub-band signals exceeding the masking threshold. The detected perceptually relevant sub-band signals then replace corresponding input sub-band signals in the target range. Unlike methods where maximum energy sub-band signals of transposed sub-band signals and the corresponding input sub-band signals are selected in the target range, input sub-band signals in the target range are replaced with transposed sub-band signals based on the masking threshold which is determined based on a perceptual model.

As used herein, the term "perceptual model" is also known as a psychoacoustic model or a masking model.

According to example embodiments, the method further comprises adjusting a spectral envelope of the detected perceptually relevant sub-band signals of the transposed sub-band signals in the target range to reduce any discontinuity at the boundary between the target range and an adjacent frequency range different from the source range between detected perceptually relevant sub-band signals of the transposed sub-band signals in the target range and input sub-band signals of the adjacent frequency range.

Without adjusting the spectral envelope after replacing input sub-band signals in the target range with corresponding detected perceptually relevant sub-band signals of the transposed sub-band signals in the target range, the envelope in the boundary between the target region and a frequency region adjacent to the target region and different from the source region, may include unnatural discontinuities. Hence, there is a desire to remove such discontinuities which may affect a user's perception of a resulting acoustic signal produced from the sub-band signals in the target range after selective replacement.

The envelope of the sub-band signals of the target range after replacement may be adjusted such that the envelope is more similar to the envelope of the input sub-band signals of the target range before replacement.

According to example embodiments the source range is above a crossover frequency and the target range is below the crossover frequency.

As used herein, a crossover frequency is a frequency at the boundary between a source range and a target range.

For embodiments where the source range is above the crossover frequency and the target range is below the crossover frequency, higher frequency sub-band signals are transposed to lower frequency sub-band signals. Such embodiments are suitable for enhancing an audio signal in relation to a hearing impairment in higher frequencies and normal or at least better hearing in lower frequencies.

According to other example embodiments the source range is below a crossover frequency and the target range is above the crossover frequency.

As used herein, a crossover frequency is a frequency at the boundary between a source range and a target range.

For embodiments where the source range is below the crossover frequency and the target range is above the crossover frequency, lower frequency sub-band signals are transposed to higher frequency sub-band signals. Such embodiments are suitable for hearing impairment in lower frequencies and normal or at least better hearing in higher frequencies.

For hearing impairments of a more complex type with normal hearing in a first range below a first frequency, hearing impairments in a second range above the first frequency and below a second frequency, normal hearing in a third range above the second frequency and below a third frequency, and hearing impairments in a fourth range above the third frequency, a combination of methods using transposing down or up from ranges with hearing impairments to ranges with normal hearing. For example, transposing and selective replacement may be made from the fourth range to the third range and from the second range to the first range, respectively.

According to example embodiments the step of selectively transposing comprises determining a first masking threshold based on a first predefined perceptual model, detecting perceptually relevant sub-band signals of the input sub-band signals in the source range, the perceptually relevant sub-band signals of the input sub-band signals in the source range exceeding the first masking threshold, and selectively transposing the detected perceptually relevant sub-band signals of the input sub-band signals in the source range into transposed sub-band signals in the target range. Furthermore, the step of determining a masking threshold comprises determining a second masking threshold based on a second predefined perceptual model. Furthermore, the step of detecting comprises detecting perceptually relevant sub-band signals of the transposed sub-band signals in the target range, the perceptually relevant sub-band signals of the transposed sub-band signals in the target range exceeding the second masking threshold.

It is to be noted that the terms "first masking threshold" and "second masking threshold" are only used to distinguish the two masking thresholds from each other in the text and not to indicate any other relation between the two masking thresholds.

It is further to be noted that the terms "first perceptual model" and "second perceptual model" are only used to distinguish the two perceptual models from each other in the text and not to indicate any other relation between the two masking thresholds. In particular, there is nothing prohibiting the two perceptual models to be the same perceptual model.

According to example embodiments with the source range above the crossover frequency and the target range below the crossover frequency, the step of selectively transposing comprises detecting one or more fricative consonant or affricate related sub-band signals of the input sub-band signals in the source range, and selectively transposing the one or more detected fricative consonant or affricate related sub-band signals of the input sub-band signals in the source range into transposed sub-band signals in the target range.

The detection of one or more fricative consonant or affricate related sub-band signals of the input sub-band signals in the source range and selectively transposing these sub-band signals to the target range aims to transpose only the most perceptually relevant sub-band signals from the source range and to reduce the risk of unnecessary replacing input sub-band signals in the target range which are perceptually relevant with transposed sub-band signals. Transposing and replacing the one or more fricative consonant or affricate related sub-band signals only and no other sub-band signals from the source range is preferable but not necessary. Transposing also other sub-bands signals than the one or more fricative consonant or affricate related sub-band signals of the input sub-band signals in the source range and replacing input sub-band signals in the source range without or with low perceptual relevance would for example normally be acceptable.

Fricative consonant and affricate sounds include frequency content in the source range which is perceptually relevant. Transposing fricative consonant and affricate related sub-band signals will provide perceptually relevant sub-band signals to the target range and hence contribute to enhancement of an audio signal.

According to example embodiments with the source range above the crossover frequency and the target range below the crossover frequency, the step of selectively transposing comprises detecting one or more vowel related sub-band signals of the input sub-band signals in the source range, wherein the one or more vowel related sub-band signals of the input sub-band signals in the source range are excluded from transposing.

Vowel related sub-band signals of the source range above the crossover frequency generally relate to harmonics and are not necessary to transpose to the target range as the fundamental is generally present in the audio signal below the crossover frequency.

According to example embodiments wherein the step of selectively transposing comprises detecting one or more background noise related sub-band signals of the input sub-band signals in the source range, wherein the one or more background noise related sub-band signals of the input sub-band signals in the source range are excluded from transposing.

According to example embodiments with the source range above the crossover frequency and the target range below the crossover frequency, the method further comprises providing consecutive test tones of an increasing frequency to a user, receiving user input indicating when the user does not hear a test tone, and selecting the crossover frequency based on the user input.

The providing of consecutive test tones of an increasing frequency and receiving input indicating when the used does not hear a test tone aims to identify a crossover frequency over which a user has an hearing impairment in a case where the user has a hearing impairment in above a crossover frequency.

In alternative embodiments, consecutive test tones of a decreasing frequency are provided to a user, and user input indicating when the user hears a test tone is received. The crossover frequency is selected based on the user input.

The providing of consecutive test tones of a decreasing frequency and receiving input indicating when the user does hear a test tone aims to identify a crossover frequency in a case where the user has a hearing impairment above the crossover frequency. This is done by identifying a first tone which the user can hear.

For a case where a user has a hearing impairment in above a crossover frequency example embodiments comprise identifying a first tone which the user can hear by providing of consecutive test tones of a decreasing frequency and receiving input indicating when the user does hear a test tone.

Alternative embodiments comprise identifying a first tone which the user can not hear by providing consecutive test tones of an increasing frequency and receiving input indicating when the user does not hear a test tone.

According to example embodiments the method further comprises selecting an upper frequency limit of the source range based on user input indicating upper frequency limit.

For example, the user can select to transpose sub-bands within one, two or more octaves above the crossover frequency.

II. Example Embodiments

FIG. 1 is a generalized block diagram of an example embodiment of a decoding system 100. In the figure thicker arrows depict an audio signal path and thinner arrows depict a control data path.

The decoding system 100 is implemented in an encoder/decoder system using the Digital Audio Compression (AC-4) Standard as disclosed in ETSI TS 103 190 V1.1.1 "Digital Audio Compression (AC-4) Standard, 2014-04.

AC-4 provides built in dialog enhancement algorithms which allow users to modify the dialog level guided by information from the encoder or content creator, both with and without a clean (separate) dialog track presented to the encoder. The Dialog Enhancement tool is a tool to increase intelligibility of the dialog in an audio scene encoded in AC-4. The underlying algorithm uses metadata encoded in the bit stream to boost the dialog in the scene. Dialog Enhancement supports enhancement of the dialog with a user-defined gain. It operates in the Quadrature Mirror Filter (QMF) domain.

An input signal/in the form of a time domain dialog input signal is received and filtered in a 64-channel analysis QMF bank 110. The QMF bank 110 splits the input signal/into complex-valued input sub-band signals and is thus over-sampled by a factor of two compared to a regular real-valued QMF bank. The input sub-band signals relate to a frequency interval comprising a source range and a target range and further frequency ranges above the source range and below the target range. For every frame with frame length of 64 time-domain input samples (frame_length), the filter bank produces 64 sub-band samples. At 48-kHz sample rate this corresponds to a nominal bandwidth of 375 Hz (24000/64 Hz), and a time resolution of 1.34 ms (64/48000 s).

The use of complex QMF enables reduction of impairments emerging from modifications of sub-band signals used in the following sections of the decoding system 100. It further provides an inherent measure of instantaneous energy for sub-band signals.

The decoder system 100 further includes a transient detection section 120 in which transient events are detected. Time/Frequency (T/F) grid selection and envelope estimation is then performed in a T/F grid selection and envelope estimation section 130. The time resolution is higher around transient events, and the frequency resolution is lower, and vice versa for the more stationary parts of the signal. Generally, longer time segments of higher frequency resolution are produced by the envelope estimator during quasi-stationary passages, while shorter time segments of lower frequency resolution are used for dynamic passages. The output of T/F grid selection and envelope estimation section is a matrix of num_qmf_subbands complex QMF sub-bands as rows and num_qmf_timeslots time slots as columns, where num_qmf_timeslots is equal to (frame_length/num_qmf_subbands), where frame_length is 64 for the present example embodiment. Envelope estimates are obtained by averaging of sub-band sample energies within T/F grids.

By deciding the time and frequency resolution to use in relation to transient detection, pre- and post-echoes are avoided that otherwise would be induced after the envelope adjustment process for transient input signals of later section of the decoding system 100. Furthermore, a better envelope estimation is provided, which enhances computing of a masking threshold in the QMF-domain used in a later section in the decoding system 100.

The T/F grid comprising complex QMF sub-bands in the source range and the target range (and further frequency ranges) is provided to a transposer detector section 140. The transposer detector section 140 determines a first masking threshold in the QMF-domain based on a first predefined perceptual model by smoothing an energy estimate of the source range sub-band signals. Sub-band signals of the input sub-band signals in the source range are detected which exceed the first masking threshold. The detected signals are the perceptually relevant sub-band signals of the input sub-band signals in the source range according to the first predefined perceptual model. The first masking threshold of a T/F grid may be selected as an average or a weighted average over a T/F grid. Perceptually relevant sub-band signals in the T/F grid are then detected as sub-band signals exceeding the average. Alternative techniques may be used, such as using a separate psychoacoustic model using a transform of its own, such as a fast Fourier transform (FFT).

The transposer detector section 140 may further detect one or more background noise related sub-band signals of the input sub-band signals in the source range. A measure based on a spectral flatness measure may for example be used as an indicator of noise in the transposer detector section 140. Such background noise related sub-band signals are then excluded from transposing.

The transposer detector section 140 may further detect one or more vowel related sub-band signals of the input sub-band signals in the source range. Such vowel related sub-band signals are then excluded from transposing.

The transposer detector section 140 may further detect perceptually relevant sub-band signals in the form of one or more fricative consonant or affricate related sub-band signals of the input sub-band signals in the source range.

First- (or higher-) order linear prediction analysis within complex-valued sub-bands in the source-range may be used for such detection. The first reflection coefficient gives an indication of spectral tilt, which indirectly gives an indication of vowel (voiced) versus fricative consonants and affricates (unvoiced). In the magnitude spectrum domain, voiced sounds in general slope downwards with increasing frequency, and unvoiced sounds slope upwards.

For complex signals, sign of the magnitude of the first reflection coefficient is an indicator of voiced versus unvoiced. The indication depends on the way the linear prediction filter is denoted.

If the filter is denoted:

$$A(z)=1+a_1z^{-1}+\ldots+a_Nz^{-N}$$

then if the reflection coefficient is +ve→unvoiced, and if −ve→vowels.

If the filter is denoted:

$$A(z)=1-a_1z^{-1}-\ldots-a_Nz^{-N}$$

then if reflection coefficient is −ve→unvoiced, and if +ve→vowels.

The detected perceptually relevant sub-band signals are provided to a transposer section 150. The transposer section 150 selectively transposes the detected perceptually relevant sub-band signals of the input sub-band signals in the source range into transposed sub-band signals in the target range. In the example embodiment patch of QMF sub-bands around a perceptually relevant sub-band are transposed from the source range to target range. The amount of lowering is calculated such that the patch of QMF sub-bands is shifted down by for example one octave (or by multiples of octaves).

The width of source patch is typically chosen to be same as or wider than the target range. If the width of the source patch is wider a compression is first performed.

A masking section 160 determines a second masking threshold based on a second predefined perceptual model. Sub-band signals of the transposed sub-band signals exceeding the second masking threshold are then detected in the target range. The detected sub-band signals are perceptually relevant sub-band signals of the transposed sub-band signals in the target range. Input sub-band signals in the target range are then replaced with corresponding detected perceptually relevant sub-band signals of the transposed sub-band signals in the target range. In other words, perceptually relevant components of the transposed and the input signal in the target-range are retained to produce modified target range sub-band signals. If the transposed sub-band signal masks the input sub-band signal in the target range, the input sub-band signal is removed, and vice-versa. Known masking rules (for the cases of TMN and NMT) are used for this purpose.

An envelope adjustment section 170 adjusts a spectral envelope of the resulting sub-band signals in the target section after replacing in the masking section 160. More specifically, since the detected perceptually relevant sub-band signals of the envelope of the transposed sub-band signals replacing the input sub-band signals in the masking section 160 may be different from the envelope of the replaced input sub-band signals in the target range. Hence, a discontinuity may arise at the boundary between the target range and an adjacent frequency range different from the source range between detected perceptually relevant sub-band signals of the transposed sub-band signals of the target range and input sub-band signals of the adjacent frequency range. The envelope adjustment section 170 performs an energy estimate of the modified target range sub-band signals. The resulting energy samples are subsequently averaged within T/F grid producing estimated envelope samples for the modified target range sub-band signals. Based on the estimated envelope of the modified target range sub-band signals and the input (unmodified) target-range sub-band signals from the T/F grid and envelope estimator section 130, energy of the modified target-range sub-band signals are adjusted.

Even though the example embodiment has been disclosed in relation to FIG. 1 aiming to enhance an audio signal in relation to a hearing impairment in a source range, where the source frequency is above a crossover frequency and a target frequency is below the crossover frequency, alternative embodiments are applicable to enhance an audio signal in relation to a hearing impairment in a source range, where the source frequency is below a crossover frequency and a target frequency is above the crossover frequency.

In a QMF synthesis section 180 a final processed signal is supplied to a 64-channel synthesis filter bank. The synthesis filter bank is just like the analysis filter bank complex-valued, however the imaginary part is discarded in the output signal O.

In alternative to using tools and blocks from AC-4, embodiments can be provided using tools and blocks from any state-of-the-art audio codec employing SBR decoder such as HE-AAC, MPEG USAC.

FIGS. 2A-D are example diagrams of an audio signal before and after transposition, selective replacement and envelope adjustment. In FIGS. 2A-D a frequency of the signal is shown in Hz along the x axis and the sound pressure level in dB is shown along the y axis. Transposition is to be performed from a source range SR above a crossover frequency CF to a target range TR below the crossover frequency CF. FIGS. 2A-D depict adjustment of the audio signal with an aim to enhance an audio signal in relation to a hearing impairment in the source range.

Alternative embodiments are applicable (not shown) to enhance an audio signal in relation to a hearing impairment in a source range, where the source range is below a crossover frequency and a target range is above the crossover frequency.

Figure 2A:
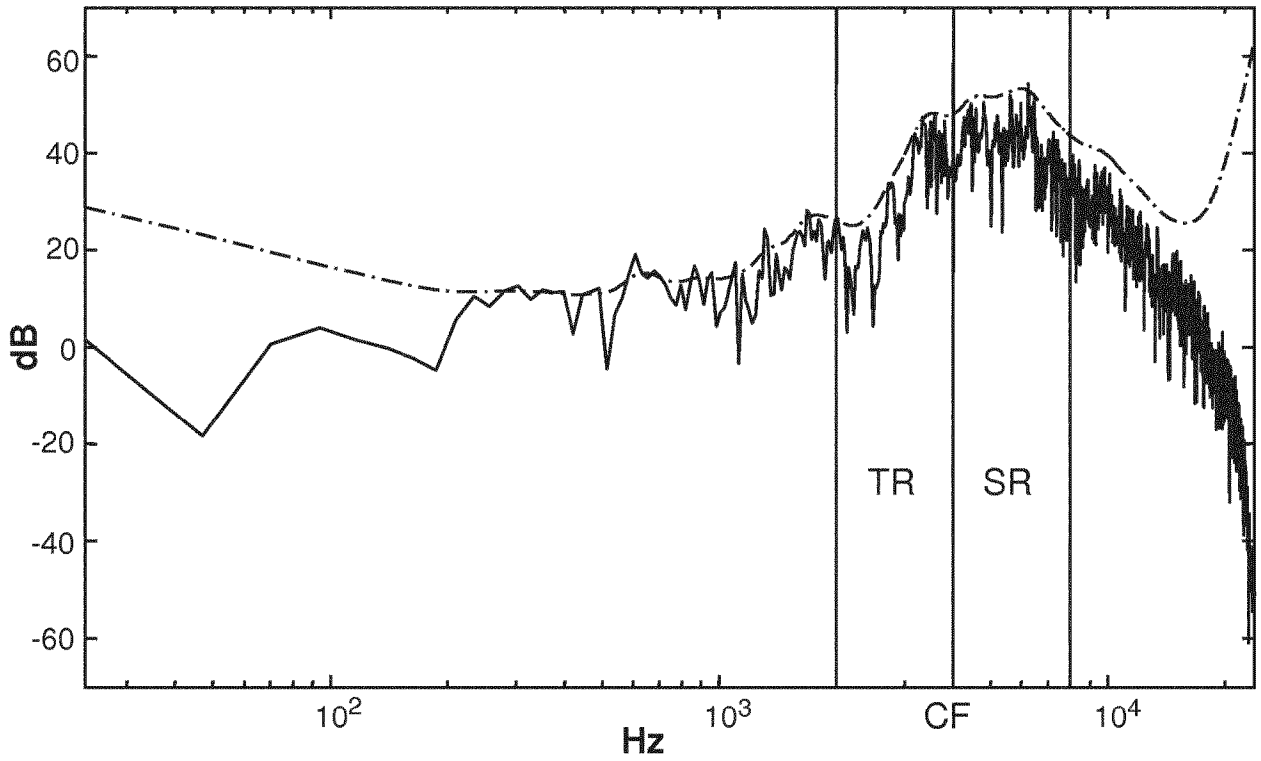
FIG. 2A is an example diagram of an audio signal before transposition.

FIG. 2A depicts an input audio signal before transposition, selective replacement and envelope adjustment as a solid line.

Figure 2B:
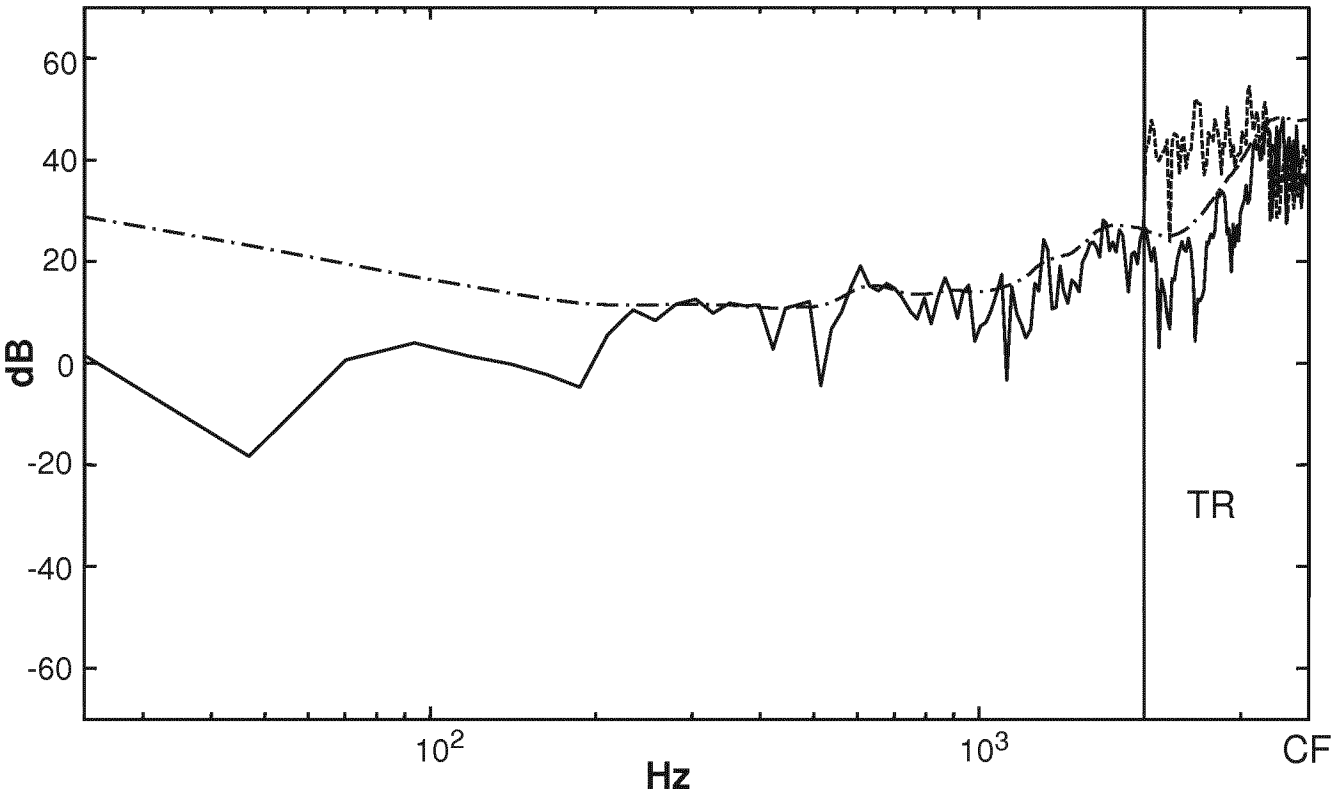
FIG. 2B is an example diagram of an audio signal after transposition.

FIG. 2B is an example diagram of the audio signal after transposition in the frequency domain of perceptually relevant sub-band signals in the source range to transposed sub-band signals in the target domain. The transposed audio signal components from the source range are depicted as a dashed line in the target range. The input audio signal components in the target range are depicted as a solid line in the target range.

Figure 2C:
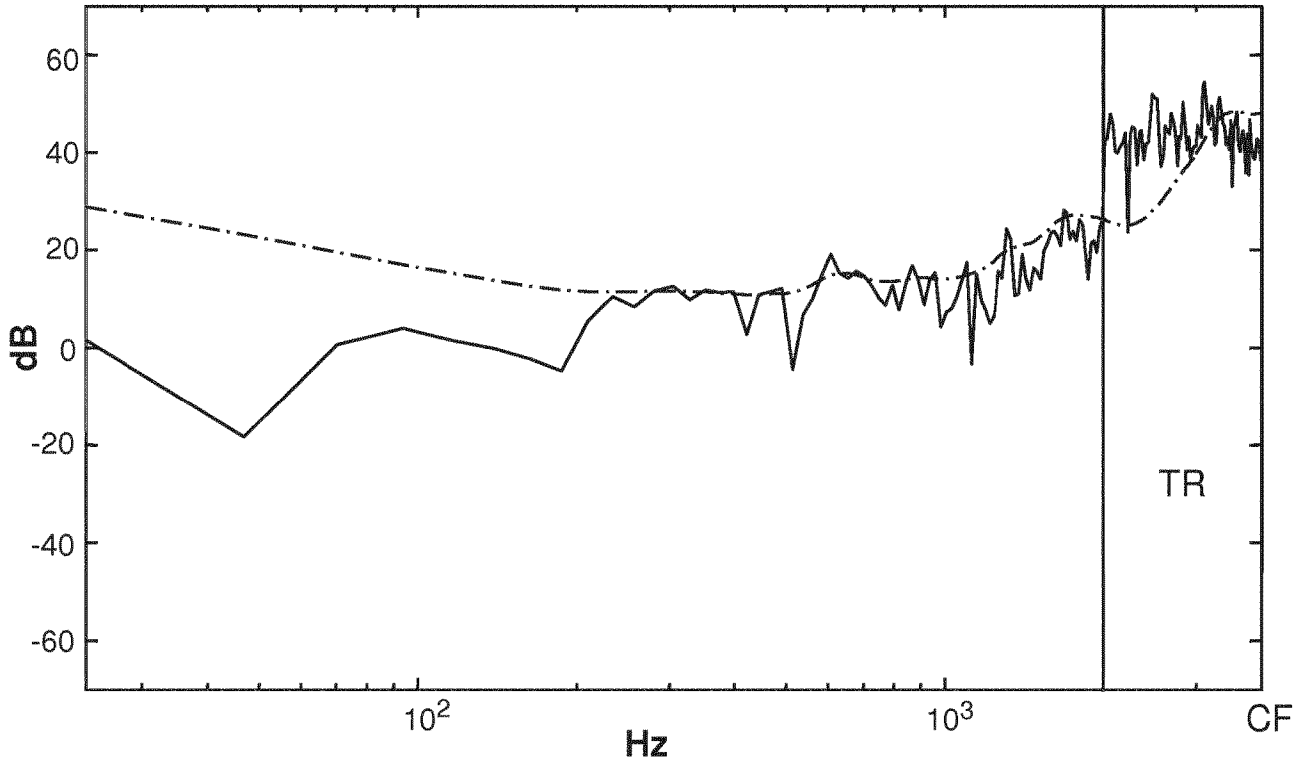
FIG. 2C is an example diagram of an audio signal after transposition and selective replacement.

FIG. 2C is an example diagram of an audio signal after transposition and selective replacement in the frequency domain of input sub-band signals in the target range with perceptually relevant sub-band signals of the transposed sub-band signals in the target range. The resulting audio signal in the target range after selective replacement is depicted as a solid line in the target range.

Figure 2D:
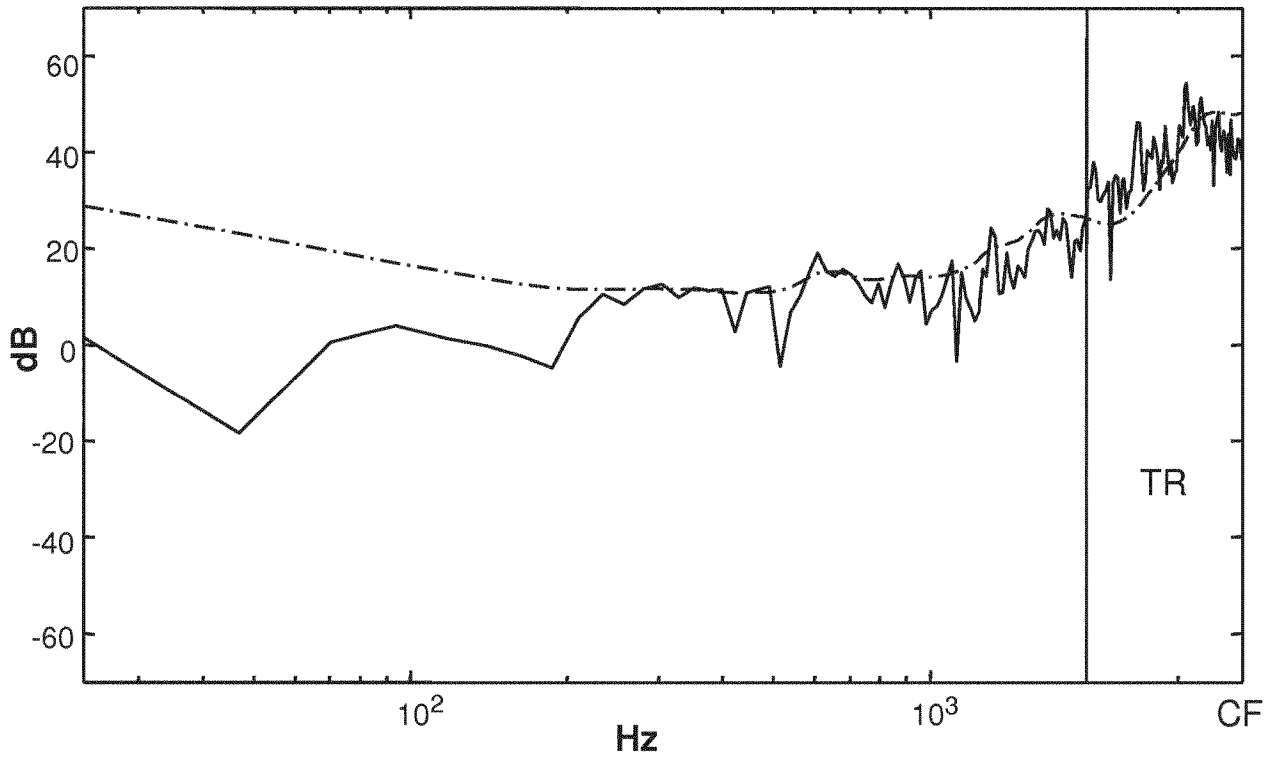
FIG. 2D is an example diagram of an audio signal after transposition, selective replacement and envelope adjustment.

FIG. 2D is an example diagram of an audio signal after transposition, selective replacement and envelope adjustment. As compared to the resulting audio signal in the target range before envelope adjustment as depicted in FIG. 2C, the envelope of the audio signal after envelope adjustment depicted in FIG. 2D has been adjusted such that it is more similar to the envelope of the audio signal in the target range before transposition and selective replacement. The resulting audio signal in the target range after envelope adjustment is depicted as a solid line in the target range.

Figure 3:
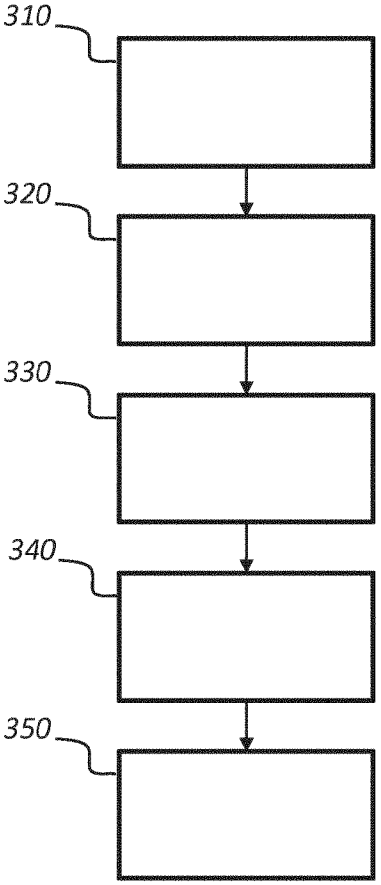
FIG. 3 is a flow chart of a method according to an example embodiment.

FIG. 3 is a flow chart of a method according to an example embodiment. In step 310 an input signal comprising input sub-band signals in a frequency range comprising a source range and a target range is obtained.

In step 320 the input sub-band signals in the source range are selectively transposed into transposed sub-band signals in the target range according to a predefined transposing rule. The transposing rule may include selectively transposing only certain input sub-band signals in the source range. For example perceptually relevant sub-band signals of the input sub-band signals exceeding a first masking threshold based on a first perceptual model are selectively transposed. According to another example one or more fricative consonant or affricate related sub-band signals of the input sub-band signals in the source range are detected as perceptually relevant sub-band signals and are selectively transposed. In addition to selection of sub-band signals to transpose, exclusion of certain sub-band signals from transposing may also be applied. For example one or more vowel related sub-band signals of the input sub-band signals in the source range, and/or one or more background noise related sub-band signals of the input sub-band signals in the source range may be excluded from transposing.

In step 330 a second masking threshold is determined based on a second predefined perceptual model, and in step 340 perceptually relevant sub-band signals of the transposed sub-band signals in the target range exceeding the second masking threshold are detected.

Finally, in step 350, input sub-band signals in the target range are replaced with corresponding detected perceptually relevant sub-band signals of the transposed sub-band signals in the target range.

The method may include a further step (not shown) where a spectral envelope of the detected perceptually relevant sub-band signals of the transposed sub-band signals in the target range are adjusted to reduce any discontinuity at the boundary between the target range and an adjacent frequency range. The adjacent frequency range is a different frequency range from the source range. More specifically, the discontinuity reduced is between detected perceptually relevant sub-band signals of the transposed sub-band signals in the target range and input sub-band signals of the adjacent frequency range.

Figure 4:
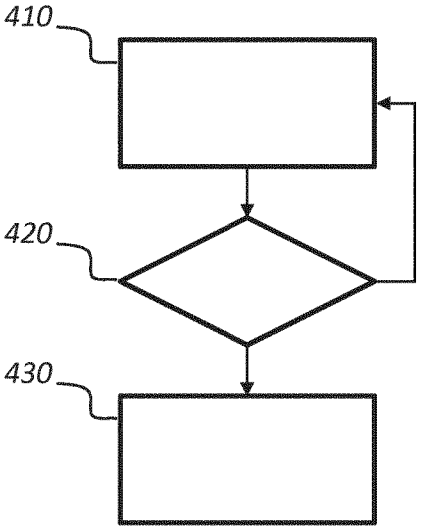
FIG. 4 is a flow chart of a method in an example embodiment.

FIG. 4 is a flow chart of a method for selecting a crossover frequency. For a situation where a user has a hearing impairment in a high frequency region, a test tone is provided to a user in step 410. If the user hears the test tone, the user provides an indication that the tone is heard. If the user does not hear the test tone, the user provides an indication that the tone is not heard. The indication is provided through suitable input means.

In step 420, it is determined in response to the indication from the user if the user has heard the test tone and if so, the method returns back to step 410 and a new test tone of a higher frequency is provided. This is repeated until it is determined in step 420 that the user has not heard the test tone. The method then proceeds to step 430 and a crossover frequency is selected based on the last test tone heard and the first test tone not heard, e.g. by selecting the frequency of the last test tone heard by the user as the crossover frequency.

Allowing the user to identify when a test tone is not heard can be achieved in several different ways. For example, the test tones can be provided together with other indication that a test tone is provided, such a visual indication. Furthermore, the test tones can be provided with a certain time interval in-between such that a user realizes that a tone is not heard when the specified time interval has passed and the user still does not hear a further test tone.

Further to selecting the crossover frequency, a further step (not shown) may be provided where an upper frequency limit of the source range is selected based on user input indicating upper frequency limit.

For a situation where a user has a hearing impairment in a low frequency region, the method 400 can be adapted by providing the test tones according to a decreasing frequency.

Even if a specific embodiment has been disclosed where test tones are provided in order of frequency, any order can be used as long as an indication from the user can be provided of whether the test tone was heard or not.

III. Equivalents, Extensions, Alternatives and Miscellaneous

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The devices and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). The software may be distributed on specially-programmed devices which may be generally referred to herein as "modules". Software component portions of the modules may be written in any computer language and may be a portion of a monolithic code base, or may be developed in more discrete code portions, such as is typical in object-oriented computer languages. In addition, the modules may be distributed across a plurality of computer platforms, servers, terminals, mobile devices and the like. A given module may even be implemented such that the described functions are performed by separate processors and/or computing hardware platforms. As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. As used in this application, the term "section" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present. Further, it is well known to the skilled person that communication media typically embodies computer readable instructions, data structures, program modules or other data in a modulated data signal such as a carrier wave or other transport mechanism and includes any information delivery media.

Various aspects of the present invention may be appreciated from the following enumerated example embodiments (EEESs):

EEE 1. A decoding system (100) for enhancing an audio signal in relation to a hearing impairment, comprising:

a transposer section (150) configured to obtain an input signal comprising input sub-band signals in a frequency range comprising a source range and a target range, and to selectively transpose the input sub-band signals in the source range into transposed sub-band signals in the target range according to a predefined transposing rule;

a masking section (160) configured to determine a masking threshold based on a predefined perceptual model, detecting perceptually relevant sub-band signals of the transposed sub-band signals in the target range, the perceptually relevant sub-band signals of the transposed sub-band signals in the target range exceeding the masking threshold, and selectively replace input sub-band signals in the target range with corresponding detected perceptually relevant sub-band signals of the transposed sub-band signals in the target range.

EEE 2. The decoding system of EEE 1, further comprising:

an envelope adjustment section (170) configured to adjust a spectral envelope of the detected perceptually relevant sub-band signals of the transposed sub-band signals in the target range to reduce any discontinuity at the boundary between the target range and an adjacent frequency range different from the source range between detected perceptually relevant sub-band signals of the transposed sub-band signals of the target range and input sub-band signals of the adjacent frequency range.

EEE 3. The decoding system of any one of EEEs 1 and 2, wherein the source range is above a crossover frequency and the target range is below the crossover frequency.

EEE 4. The decoding system of any one of EEEs 1-3, further comprising a transposer detector section (140) configured to determine a first masking threshold based on a first predefined perceptual model, detect perceptually relevant sub-band signals of the input sub-band signals in the source range, the perceptually relevant sub-band signals of the input sub-band signals in the source range exceeding the first masking threshold, wherein the transposer section (150) is further configured to selectively transpose the detected perceptually relevant sub-band signals of the input sub-band signals in the source range into transposed sub-band signals in the target range, and wherein the masking section (160) is configured to determine a second masking threshold based on a second predefined perceptual model, detecting perceptually relevant sub-band signals of the transposed sub-band signals in the target range, the perceptually relevant sub-band signals of the transposed sub-band signals in the target range exceeding the second masking threshold.

EEE 5. The decoding system of EEE 3, further comprising:

a transposer detector section (140) configured to detect one or more fricative consonant or affricate related sub-band signals of the input sub-band signals in the source range, wherein the transposer section (150) is configured to selectively transpose the one or more detected fricative consonant or affricate related sub-band signals of the input sub-band signals in the source range to transposed sub-band signals in the target range.

EEE 6. The decoding system of EEE 3, further comprising:

a transposer detector section (140) configured to detect one or more vowel related sub-band signals of the input sub-band signals in the source range, and to exclude the one or more vowel related sub-band signals of the input sub-band signals in the source range from transposing.

EEE 7. The decoding system of any one of EEEs 4-6, wherein the transposer detector section (140) is further configured to detect one or more background noise related sub-band signals of the input sub-band signals in the source range, and to exclude the one or more background noise related sub-band signals in the source range from transposing.

EEE 8. The decoding system of any one of EEEs 2, 5 and 6, further comprising:

an audio output section configure to provide consecutive test tones of an increasing frequency to a user;

a user input section configured to receive user input indicating when the user does not hear a test tone; and a selection section configured to select the crossover frequency based on the user input.

EEE 9. The decoding system of EEE 8, wherein the selection section is further configured to select an upper frequency limit of the source range based on user input indicating upper frequency limit.

EEE 10. The decoding system of EEE 1, wherein the source range is above a crossover frequency and the target range is below the crossover frequency.

The invention claimed is:

1. A method for enhancing an audio signal in relation to a hearing impairment, comprising:

obtaining an input signal comprising input sub-band signals in a frequency range comprising a source range and a target range;

selectively transposing the input sub-band signals in the source range into transposed sub-band signals in the target range according to a predefined transposing rule;

determining a masking threshold based on a predefined perceptual model;

detecting perceptually relevant sub-band signals of the transposed sub-band signals in the target range, the perceptually relevant sub-band signals of the transposed sub-band signals in the target range exceeding the masking threshold; and selectively replacing input sub-band signals in the target range with corresponding detected perceptually relevant sub-band signals of the transposed sub-band signals in the target range.

2. The method of claim 1, further comprising:

adjusting a spectral envelope of the detected perceptually relevant sub-band signals of the transposed sub-band signals in the target range to reduce any discontinuity at the boundary between the target range and an adjacent frequency range different from the source range between detected perceptually relevant sub-band signals of the transposed sub-band signals in the target range and input sub-band signals of the adjacent frequency range.

3. The method of claim 1, wherein the source range is above a crossover frequency and the target range is below the crossover frequency.

4. The method according to claim 3, wherein the step of selectively transposing comprises:

detecting one or more fricative consonant or affricate related sub-band signals of the input sub-band signals in the source range, selectively transposing the one or more detected fricative consonant or affricate related sub-band signals of the input sub-band signals in the source range into transposed sub-band signals in the target range.

5. The method according to claim 3, wherein the step of selectively transposing comprises:

detecting one or more vowel related sub-band signals of the input sub-band signals in the source range, wherein the one or more vowel related sub-band signals of the input sub-band signals in the source range are excluded from transposing.

6. The method of claim 3, further comprising:

providing consecutive test tones of an increasing frequency to a user;

receiving user input indicating when the user does not hear a test tone; and selecting the crossover frequency based on the user input.

7. The method of claim 6, further comprising:

selecting an upper frequency limit of the source range based on user input indicating upper frequency limit.

8. The method of claim 1, wherein the step of selectively transposing comprises:

determining a first masking threshold based on a first predefined perceptual model;

detecting perceptually relevant sub-band signals of the input sub-band signals in the source range, the perceptually relevant sub-band signals of the input sub-band signals in the source range exceeding the first masking threshold; and selectively transposing the detected perceptually relevant sub-band signals of the input sub-band signals in the source range into transposed sub-band signals in the target range, wherein the step of determining a masking threshold comprises:

determining a second masking threshold is based on a second predefined perceptual model, and wherein the step of detecting comprises:

detecting perceptually relevant sub-band signals of the transposed sub-band signals in the target range, the perceptually relevant sub-band signals of the transposed sub-band signals in the target range exceeding the second masking threshold.

9. The method according to claim 1, wherein the step of selectively transposing comprises:

detecting one or more background noise related sub-band signals of the input sub-band signals in the source range, wherein the one or more background noise related sub-band signals of the input sub-band signals in the source range are excluded from transposing.

10. The method of claim 1, wherein the source range is below a crossover frequency and the target range is above the crossover frequency.

11. A decoding system for enhancing an audio signal in relation to a hearing impairment, comprising:

a transposer section configured to obtain an input signal comprising input sub-band signals in a frequency range comprising a source range and a target range, and to selectively transpose the input sub-band signals in the source range into transposed sub-band signals in the target range according to a predefined transposing rule;

a masking section configured to determine a masking threshold based on a predefined perceptual model, detecting perceptually relevant sub-band signals of the transposed sub-band signals in the target range, the perceptually relevant sub-band signals of the transposed sub-band signals in the target range exceeding the masking threshold, and selectively replace input sub-band signals in the target range with corresponding detected perceptually relevant sub-band signals of the transposed sub-band signals in the target range.

12. The decoding system of claim 11, further comprising:

an envelope adjustment section configured to adjust a spectral envelope of the detected perceptually relevant sub-band signals of the transposed sub-band signals in the target range to reduce any discontinuity at the boundary between the target range and an adjacent frequency range different from the source range between detected perceptually relevant sub-band signals of the transposed sub-band signals of the target range and input sub-band signals of the adjacent frequency range.

13. The decoding system of claim 11, wherein the source range is above a crossover frequency and the target range is below the crossover frequency.

14. The decoding system of claim 11, further comprising a transposer detector section configured to determine a first masking threshold based on a first predefined perceptual model, detect perceptually relevant sub-band signals of the input sub-band signals in the source range, the perceptually relevant sub-band signals of the input sub-band signals in the source range exceeding the first masking threshold, wherein the transposer section is further configured to selectively transpose the detected perceptually relevant sub-band signals of the input sub-band signals in the source range into transposed sub-band signals in the target range, and wherein the masking section is configured to determine a second masking threshold based on a second predefined perceptual model, detecting perceptually relevant sub-band signals of the transposed sub-band signals in the target range, the perceptually relevant sub-band signals of the transposed sub-band signals in the target range exceeding the second masking threshold.

15. A computer program product comprising a computer-readable medium with instructions for performing the method claim 1 when executed by a device having processing capability.

* * * * *